United States Patent [19]

Suter et al.

[11] Patent Number: 4,578,659

[45] Date of Patent: Mar. 25, 1986

[54] COUPLING SYSTEM BETWEEN AN ELECTROMAGNETIC SWITCH APPARATUS AND AN AUXILIARY CONTACT BLOCK RELEASABLY MOUNTED THEREUPON

[75] Inventors: Heinz Suter, Aarau; Alex Blum, Unterentfelden, both of Switzerland

[73] Assignee: Sprecher & Schuh AG, Aarau, Switzerland

[21] Appl. No.: 672,110

[22] Filed: Nov. 15, 1984

[30] Foreign Application Priority Data

Nov. 28, 1983 [CH] Switzerland ..... 6338/83

[51] Int. Cl.[4] ..... H01H 51/06

[52] U.S. Cl. ..... 335/131; 335/132

[58] Field of Search ..... 335/132, 131, 128, 135, 335/198, 159, 160, 161

[56] References Cited

U.S. PATENT DOCUMENTS 3,671,891 6/1972 Usui et al. ..... 335/132

4,490,701 12/1984 Dietrich et al. ..... 335/131

4,513,269 4/1985 Miyamoto ..... 335/132

*Primary Examiner*—Harold Broome

*Attorney, Agent, or Firm*—Ladas & Parry

[57] ABSTRACT

The coupling system is assembled upon the placing of the auxiliary contact block including its dogs integrally formed at its bearing surface and its coupling member including a coulisse onto the switch apparatus followed by a shifting of the auxiliary contact block. When placing the auxiliary contact block onto the switch apparatus the dogs engage between tooth-shaped projections in the trough built on the switch apparatus. During the shifting carried out thereafter, the dogs are shifted under the projections and moved into engagement. A catch is located in the trough, which catch is integrally formed on the movable contact carrier of the switch apparatus and which catch upon shifting of the auxiliary contact block is moved in the coulisse of the coupling member formed on the auxiliary contact carrier. This form locked and releasable coupling is safeguarded against a shifting by means of locking members.

5 Claims, 3 Drawing Figures

COUPLING SYSTEM BETWEEN AN ELECTROMAGNETIC SWITCH APPARATUS AND AN AUXILIARY CONTACT BLOCK RELEASABLY MOUNTED THEREUPON

BACKGROUND OF THE INVENTION

1. Field of the Invention

The present invention relates to a coupling system between an electromagnetic switch apparatus and an auxiliary contact block releasably mounted thereupon, the coupling system intended to actuate, by the agency of a catch projecting out of the casing of the switch apparatus and displaceable upon actuation of the switch apparatus, an auxiliary contact carrier slidingly supported in the auxiliary contact block and having a coupling member projecting out of said contact block.

2. Description of the Prior Art

A coupling system of the kind set forth above is disclosed in the German published patent application DE-OS No. 16 15 903. If the auxiliary contact block is removed, the catch of mentioned coupling system projects out of the casing of the switch apparatus. Projecting structures are, however, not desired. The catch itself is designed as a plunger which holds the auxiliary contact carrier in the OFF-position against the action of a force. If the switch apparatus is switched in, the plunger is pulled back into the casing of the switch apparatus and the auxiliary contact carrier follows this movement under action of a spring. The design of this system provides no positive coupling between the movements of the plunger and of the auxiliary contact carrier which in case, for instance upon a drop out of the spring acting upon the auxiliary contact carrier can lead to an uncontrolled movement of the auxiliary contact carrier.

SUMMARY OF THE INVENTION

An object of the present invention is to provide a coupling system between an electromagnetic switch apparatus and an auxiliary contact block releasably mounted thereupon, which allows a positive coupling therebetween without any structures projecting out of the switch apparatus.

A further object is to provide a coupling system in which upon operation of the switch apparatus the catch thereof shifts parallel to the bearing surface of the auxiliary contact block and is located in a rectangular trough of the casing of the switch apparatus, further in which the coupling member which is operatively connected to the catch projects into said trough, and in which the two edges of the trough which extend laterally relative to the direction of movement of the catch are provided with a plurality of tooth shaped projections projecting into the trough opening of which the distance between the teeth are larger than the width of the teeth, further in which dogs integrally formed at the bottom of the auxiliary contact block and having at least approximately the width and distance of the projections grip under said projections, which form closed connection is releasable by a mutual shifting of casing and auxiliary contact block laterally relative to the direction of movement of the catch.

A further object is to provide locking members arranged between the casing and the auxiliary contact block which interlock upon the dogs gripping under the projections. Preferably the locking members are located outside of the area of the trough.

A further object is to provide a coupling member comprising a coulisse extending laterally relative to its direction of movement and is open towards the outside and in which the catch is a plug engaging into the coulisse. This coulisse may comprise preferably a funnel shaped capture range for a lateral insertion of the plug into the coulisse.

BRIEF DESCRIPTION OF THE DRAWINGS

The invention will be better understood and objects other than those set forth above will become apparent when consideration is given to the following detailed description thereof. Such description makes reference to the annexed drawings, wherein.

DESCRIPTION OF THE PREFERRED EMBODIMENT

Figure 1:
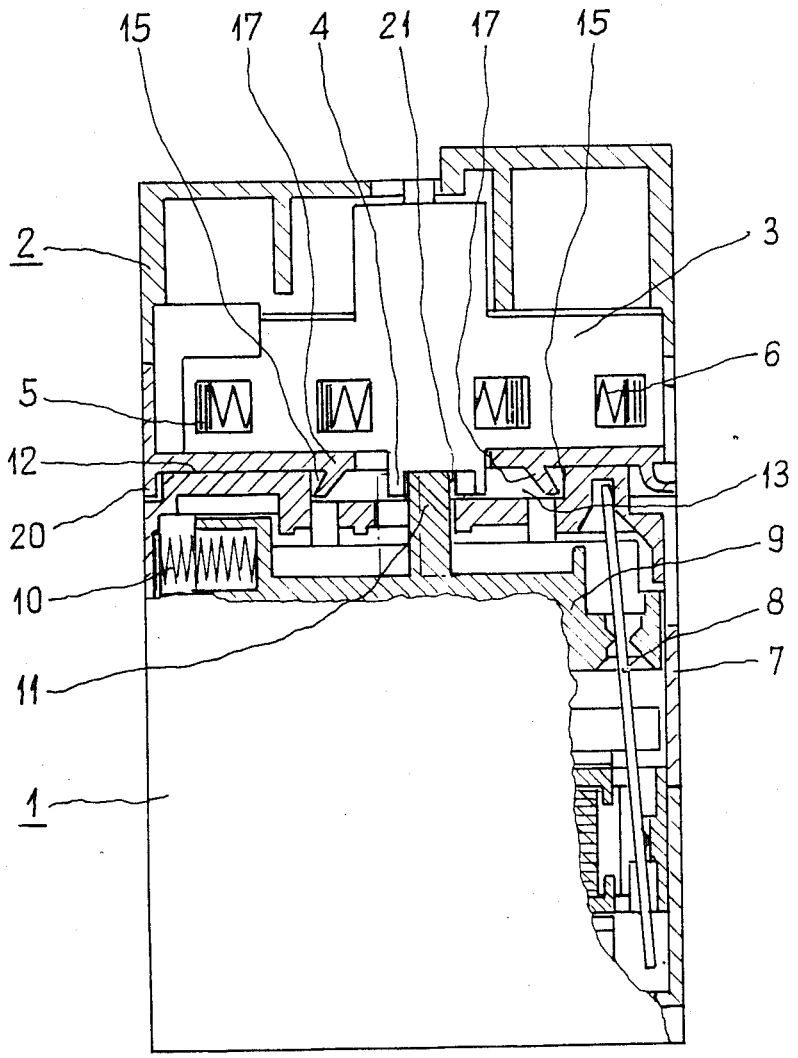
FIG. 1 illustrates schematically a coupling system between an electromagnetic switch apparatus and an auxiliary contact block and designed partly in section.

In FIG. 1 only those structural elements of the electromagnetic switch apparatus 1 and of the auxiliary contact block 2 are illustrated, which are necessary for the understanding of the coupling system between these two apparatuses. An auxiliary contact carrier 3 is movably supported in the auxiliary contact block 2. A coupling member 4 is integrally formed at its lower section, which coupling member 4 projects out of the auxiliary contact block 2. The contact ridges 5 set into the auxiliary contact carrier 3 as well as the contact pressure spring 6 are designed schematically only.

The electromagnetic switch apparatus 1 comprises an electromagnet not particularly illustrated, which electromagnet pulls upon excitation thereof and shifts the contact carrier 9 against the force of its reset spring 10 via an operating lever 8 supported in the casing 7 of the switch apparatus 1 into the ON-position. A catch 11 is integrally formed at the contact carrier 9 and projects out from the casing 7 of the switch apparatus 1. Upon actuation of the switch apparatus 1 this catch 11 shifts parallel to the bearing surface 12 of the auxiliary contact block 2 and pushes the coupling member 4 of the auxiliary contact carrier 3 operatively connected thereto also into the ON-position. This catch 11 is located in a trough 13 formed at the side of the casing 7 which faces the bearing surface 12. This design follows in that the electromagnetic switch apparatus without the auxiliary contact block 2 set thereupon comprises no projecting structural members.

The edges of the trough 11 extending laterally relative to the direction of motion 14 of the catch 11 are provided with a plurality of projections 15, 16 arranged at a mutually distance from each other and having a tooth shaped form, which projections 15, 16 project into the opening of the trough. The distance between the individual teeth are larger than the width of the teeth. Dogs 17, 18 are integrally formed at the bottom of the auxiliary contact block 2, which dogs have a width and mutual distances which conform at least approximately to those of the projections 15, 16.

Locking members 19, 20 are provided between the casing 7 and the auxiliary contact block 2. Thereby, the locking catch 19 is located at the casing 7 and the locking spring 20 at the auxiliary contact block 2 and specifically outside of the area of the trough.

A coulisse 21 which is open in outwards direction and which has a funnel shaped capture range is formed at the coupling member 4 and extends laterally to the direction of motion.

Figure 2:
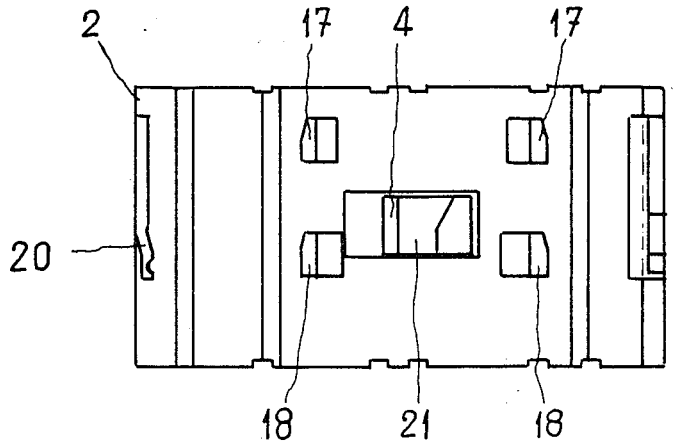
FIG. 2 is a view of an auxiliary contact block.
Figure 3:
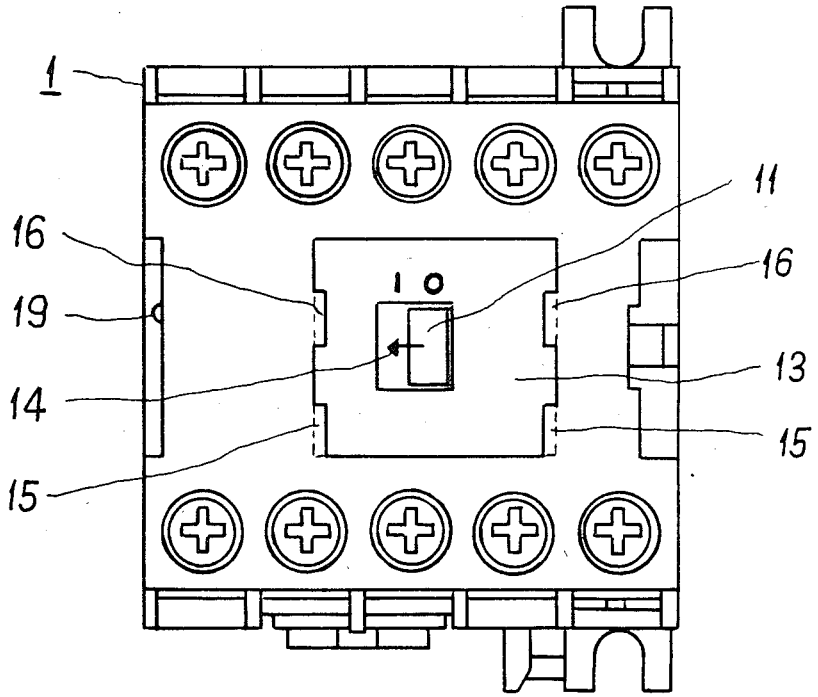
FIG. 3 is a view of the switch apparatus from the opposite bearing surface.

The coupling system is assembled upon placing the auxiliary contact block 2 at its bearing surface shown in FIG. 2 onto the top surface of the electromagnetic switch apparatus 1 illustrated in FIG. 3. The dogs are inserted into the trough 13 in that the dogs 17 are inserted between the projections 15 and 16 and the dogs 18 inserted between the projections 16 and the rear edge of the trough. In this position the coupling member 4 grips with its funnel shaped capture range in the coulisse 21 around the catch 11. This design allows the placing or mounting, respectively, of an auxiliary contact block 2 without the need of a reset spring. During the assembling the coupling member 4 can be located at any arbitrary position of its stroke. After the inserting of the dogs 17, 18 and of the coupling member 4 into the trough 13 the dogs 17 and the projections 15 as well as the dogs 18 and the projections 16 can be brought into mutual engagement by a shifting of the auxiliary contact block 2. After terminating this shifting of the auxiliary contact block 2 the catch 11 is located in the coulisse 21 of the coupling member 4 such that the operative connection between the movable members of the electromagnetic switch apparatus 1 and of the auxiliary contact block 2 is provided. The locking spring 20 which locks at the locking catch 19 when the coupling system is in its operative position provides the safety means of the mechanical interconnection against a possible relative shifting.

While there is shown and described a present preferred embodiment of the invention, it is to be distinctly understood that the invention is not limited thereto, but may be otherwise variously embodied and practiced within the scope of the following claims.

We claim:

1. A coupling system with a first part which is connected to an electromagnetic switch apparatus and with a second part which is connected to an auxiliary contact block releasably mounted on said switch apparatus in order to connect the casing (7) of the switch apparatus (1) with the auxiliary contact block (2) and in order to actuate an auxiliary contact carrier slidingly supported in the auxiliary contact block and which has a coupling member projecting out of said contact block, wherein this actuation is performed through a catch which projects out of the casing of the switch apparatus and which, upon actuation of the switch apparatus is displaced parallel to the bearing surface of the auxiliary contact block (2) on said casing, wherein said catch is located in a rectangular through (13) of the casing (7) of the switch apparatus (1), and wherein a coupling member (4) which is operatively connected to the catch projects into said trough, and wherein the two edges of the trough which extend transversally relative to the direction of movement of the catch are provided with a plurality of tooth-shaped projections projecting into the trough opening in order to connect the casing with the auxiliary contact block (2), wherein the distances between the teeth are larger than the width of the teeth, wherein dogs are integrally formed at the bottom of the auxiliary contact block, these dogs (17, 18) having at least approximately the same width and mutual distances as the projections (15, 16) in order to fit under these projections when the coupling system is locked, and in order to release the casing (1) from the auxiliary contact block (2) when said coupling system is unlocked by a shift of the casing relative to the auxiliary contact block in a direction transversal to the movement of the catch.

2. The coupling system of claim 1, comprising locking members arranged between the casing and the auxiliary contact block which interlock upon the dogs gripping under the projections.

3. The coupling system of claim 2, in which the locking members are located outside of the area of the trough.

4. The coupling system of claim 1, in which said coupling member comprises a coulisse extending laterally relative to its direction of movement and being open toward the outside, and in which said catch is a plug engaging into the coulisse.

5. The coupling system of claim 4, in which the coulisse comprises a funnel shaped capture range for a lateral insertion of said plug into said coulisse.

* * * * *